US006676285B2

(12) United States Patent
Qureshi

(10) Patent No.: US 6,676,285 B2
(45) Date of Patent: Jan. 13, 2004

(54) LOW SPEED PRECISION STIRRING/ MIXING DEVICE

(75) Inventor: Saeed A. Qureshi, Nepean (CA)

(73) Assignee: Her Majesty the Queen in right of Canada, as represented by the Minister of Health, Ottawa (CA)

( * ) Notice: Subject to any disclaimer, the term of this patent is extended or adjusted under 35 U.S.C. 154(b) by 9 days.

(21) Appl. No.: 10/100,134

(22) Filed: Mar. 19, 2002

(65) Prior Publication Data

US 2003/0058735 A1 Mar. 27, 2003

(30) Foreign Application Priority Data

Sep. 26, 2001 (CA) ..... 2358575

(51) Int. Cl.[7] ..... B01F 7/16
(52) U.S. Cl. ..... 366/279; 366/325.2; 366/309
(58) Field of Search ..... 15/164, 165, 70, 15/71, 73, 75, 65, 66, 59, 57, 56, 74, 58; 366/325.2, 325.5, 129, 309, 342, 343, 279

(56) References Cited

U.S. PATENT DOCUMENTS

| | | | | | |
|---|---|---|---|---|---|
| 355,054 | A | * | 12/1886 | Bennett | 15/66 |
| 444,710 | A | * | 1/1891 | McPherson | 15/73 |
| 519,948 | A | * | 5/1894 | Hahn | 15/164 |
| 525,138 | A | * | 8/1894 | Detwiler | 366/309 |
| D28,707 | S | * | 5/1898 | Whittemore | 15/164 |
| 614,305 | A | * | 11/1898 | Jones | 15/165 |
| 671,516 | A | * | 4/1901 | Hegner | 366/343 |
| 772,302 | A | * | 10/1904 | Widness | 15/164 |
| 902,577 | A | * | 11/1908 | Hall | 366/309 |
| 922,458 | A | * | 5/1909 | Clarkson | 15/165 |
| 1,014,236 | A | * | 1/1912 | Lawhon | 15/73 |
| 1,317,523 | A | * | 9/1919 | Meyer et al. | 15/75 |
| 1,417,965 | A | | 5/1922 | Belcher | |
| 1,486,626 | A | * | 3/1924 | Betley | 15/73 |
| 1,507,971 | A | * | 9/1924 | Lomp | 15/164 |
| 1,564,388 | A | * | 12/1925 | Westvig | 15/164 |
| 1,652,213 | A | * | 12/1927 | Pulver | 15/164 |
| 1,678,943 | A | * | 7/1928 | Jackson | 15/164 |
| 1,831,684 | A | * | 11/1931 | Petersen | 15/56 |
| 2,018,086 | A | * | 10/1935 | Parsons | 15/164 |
| 2,214,684 | A | * | 9/1940 | Stinnett | 15/164 |
| 2,420,260 | A | * | 5/1947 | Myszkowski | 15/165 |
| 2,432,924 | A | * | 12/1947 | Nishizaka et al. | 15/165 |
| 2,513,719 | A | * | 7/1950 | Glass | 15/164 |

(List continued on next page.)

FOREIGN PATENT DOCUMENTS

| | | |
|---|---|---|
| CA | 1038858 | 9/1978 |
| CA | 1052766 | 4/1979 |

OTHER PUBLICATIONS

Japanese Patent Abstracts JP–09–150046; JP–07–232047; JP–07–108152; JP 57–053229; JP–57–004218; and JP–55–099328.

*Primary Examiner*—Tony G. Soohoo
(74) *Attorney, Agent, or Firm*—Kent Daniels Ogilvy Renault

(57) ABSTRACT

A mixing device for low speed precision mixing of contents of a vessel has a support member adapted to be rotatably supported in spaced relationship from a bottom portion of the vessel and separated therefrom by a gap, and a brush assembly depending from the support member for sliding engagement with the bottom portion of the vessel. Low speed rotation of the support member within the vessel causes the brush assembly to sweep the bottom portion of the vessel while mixing the contents of the vessel. The brush assembly can be made of a resilient coil or a plurality of filamentary or lamellar elements, affixed to the support member. This device provides controlled and repeatable mixing and is well suited for use in drug dissolution measurement apparatuses used for assessing drug release characteristics of solid oral pharmaceutical products.

1 Claim, 3 Drawing Sheets

U.S. PATENT DOCUMENTS 2,529,952 A * 11/1950 Leunis ..... 15/164
2,546,285 A * 3/1951 Wittmann ..... 366/129
2,675,572 A * 4/1954 Komiya ..... 15/164
2,839,771 A * 6/1958 Hunter ..... 15/164
2,878,501 A * 3/1959 Brennan ..... 15/164
3,451,723 A * 6/1969 Marks ..... 15/164
3,750,214 A * 8/1973 Calliendo et al. ..... 15/165
3,862,461 A * 1/1975 Bucklitzsch ..... 15/164
3,991,983 A * 11/1976 Drynan ..... 366/129
4,197,018 A 4/1980 Groen, Jr. ..... 366/248
4,630,932 A 12/1986 Revelli et al. ..... 366/279
4,884,895 A * 12/1989 Rodgers ..... 366/343
5,339,480 A * 8/1994 Murg et al. ..... 15/164
5,608,938 A * 3/1997 Baschenis ..... 15/164
5,908,241 A 6/1999 Bliss et al. ..... 366/129

* cited by examiner

LOW SPEED PRECISION STIRRING/ MIXING DEVICE

CROSS-REFERENCE TO RELATED APPLICATIONS

This application is based on, and claims priority of, Canadian Patent Application No. 2,358,575 filed on Sep. 26, 2001.

MICROFICHE APPENDIX

Not Applicable.

TECHNICAL FIELD

The present invention relates to the field of dissolution measurement and, more particularly, to a low-speed precision stirring/mixing device for repeatable dissolution of solid or granular material.

BACKGROUND OF THE INVENTION

A solid oral pharmaceutical product, such as a tablet or capsule, is generally composed of a mixture of active ingredient(s) and excipient (i.e., pharmacologically inactive ingredients compressed into a desired shape). When the product is administered to a patient, it is expected that the active ingredient will be released into the gastrointestinal (GI) tract in a predictable and reproducible manner which, in turn, is absorbed into systemic circulation to elicit the desired effect. There are a number of factors such as: nature and composition of active and inactive ingredients, manufacturing process, and/or storage conditions which can alter the drug release characteristics of a product, and consequently the outcome in a patient.

Generally used methodology to assess the drug release characteristics of products in humans is known as a bio-availability and/or bio-equivalence study, also commonly termed as a bio-study. In these studies, following a set protocol, a drug product is administered to human volunteers and a number of blood samples are withdrawn at different time intervals. Using sophisticated analytical techniques such as chromatography, these blood samples are then analyzed to determine the drug levels. The resulting blood concentration-time profiles form the basis of bio-availability and bio-equivalence assessment. Based on the area under the profile and its peak value (highest observed concentration, usually denoted by Cmax), the extent and rate of drug release and absorption is established and compared to profiles obtained from different products. This is the fundamental concept in the drug release evaluation to establish safety, efficacy and quality aspects of a drug product. Any time that (a) a new product is developed, or (b) significant changes are made to an existing product, or (c) the manufacturing process is altered, the quality of the products, with respect to their drug release characteristics, has to be tested following this route.

Ethical concerns severely limit the conduct of these studies in humans. Further, conducting these bio-studies is usually very expensive and time consuming. Thus, because of cost, time and ethical considerations, it is not always possible to conduct drug release studies in humans. As a result an in vitro drug release evaluation test is a commonly used alternative. For this purpose, an in vitro test (known as a dissolution test) has been developed and has become a tool for both product development and quality assurance. This test is routinely conducted at every stage of drug product development, manufacturing, and post-manufacturing assessments.

In a drug dissolution test, drug release from a product is determined in an aqueous dissolution medium (water or buffers) with mild agitation or stirring to simulate drug release in GI environments. The logic behind assessing the drug release in water or aqueous buffer solution is that, if a drug is to be absorbed from the GI tract into the systemic circulation, the drug has to be in a solution form. Thus, any changes in drug release characteristics in solution should, at least in theory, be reflected in corresponding changes in drug availability in systemic circulation.

Presently, drug dissolution testing is conducted using recommended compendial methods, such as the U.S. Pharmacopoeia. Four different types of apparatus, based on different mixing methods are available commercially and have compendial recognition. These apparatuses are known as: paddle; basket; flow-through; and reciprocating cylinder.

Of these four types of apparatus, the paddle apparatus is the most commonly used. As may be seen in FIG. 1, the paddle apparatus provides a mixing vessel 2 (which is typically round-bottomed) into which an aqueous medium 4 is placed. Stirring of the aqueous medium 4 is achieved by means of a T-shaped paddle 6 which is supported within the vessel and rotated by a motor-driven spindle (not shown). A typical paddle apparatus normally has six or twelve dissolution vessels 2, to enable simultaneous testing of multiple samples.

When a product (tablet or capsule) is dropped into the dissolution vessel 2, the stirring/mixing is achieved by rotating the paddle 6 at a desired speed, typically 50–100 rpm. At specific times, samples of the dissolution medium are withdrawn and the percentage of the drug dissolved is determined using any of the conventional analytical methods such as UV or liquid chromatography. Cumulative drug release as a percentage of the dosage strength is then calculated and reported, describing the drug release characteristic in vitro.

A limitation of the conventional paddle apparatus is that the rotating paddle 6 creates a vortex effect, allowing the disintegrated (powdered) product 8 to accumulate at the bottom of the vessel 2. This reduces the available surface area of solid particles, reducing interaction between these particles and the dissolution medium, which leads to artificially low dissolution rates. This can cause the current methodology to provide inaccurate and non-repeatable estimates of drug release rates.

Low speed mixing devices are known in non-analogous arts, such as dough making. Examples of such devices are shown in Canadian Patents No. 1,052,766 to Kramer and No. 1,038,858 to Smader, in which a kneading arm has a shape that conforms approximately to the bottom shape of the mixing vessel. However, this arm is the only active part in the mixing of the material, and is designed for high torque mixing to provide a high shearing effect to force the material together. Lumps and irregularities in cohesive material are broken by high shearing forces within the dough. This can be efficient with highly cohesive material (such as flour and water), but will leave material at the bottom of the mixing vessel in any other situation.

U.S. Pat. No. 4,197,018 to Groen discloses a mixer for a cooking vessel in which an arm follows closely the shape of the bottom part of the vessel. The principal effect of this arm is to scrape the bottom of the vessel. A stirring blade pushes the material around. This is only useful in a context of floating material and to prevent any material from sticking to the vessel. The combined surface of the arm and of the stirring blade is far too large for an efficient mixing of material, and is designed more to push the material around the vessel so that it will not stick to the vessel.

The use of brushes for mixing material is disclosed in several United States patent documents (see, for example, U.S. Pat. Nos. 4,630,932, 1,417,965) and Japanese patent documents (see, for example, JP-09-150046, JP-07-232047, JP-07-108152, JP-57-053229, JP-57-004218, and 55-099328). However, the devices disclosed in these patents are designed for high-speed mixing/grinding (thus high-shear) to provide disturbed fluid flow effects to mix/break the material.

U.S. Pat. No. 5,908,241 discloses a variation on the preceding devices, in which brushes are replaced by a helical open coil for mixing. This device also relies on the high shear fluid flow effects to mix/break the material.

These prior art mixing devices are not suitable for high precision mixing, such as is required in dissolution testing. Therefore, an apparatus and method for improved precision mixing remains highly desirable.

SUMMARY OF THE INVENTION

Accordingly, the present invention provides a low-speed precision stirring/mixing device for dissolution of solid or granular material for use in measuring the release characteristics of an active ingredient in a pharmaceutical product.

Thus, an aspect of the present invention provides a mixing device for low speed precision mixing of contents of a vessel. The mixing device comprises a support member adapted to be rotatably supported in spaced relationship from a bottom portion of the vessel and separated therefrom by a gap; and a brush assembly depending from the support member for sliding engagement with the bottom portion of the vessel. Low speed rotation of the support member within the vessel causes the brush assembly to sweep the bottom portion of the vessel while mixing the contents of the vessel.

Preferably, the brush assembly comprises a resilient coil or a plurality of filamentary or lamellar elements, affixed to the support member.

BRIEF DESCRIPTION OF THE DRAWINGS

Further features and advantages of the present invention will become apparent from the following detailed description, taken in combination with the appended drawings, in which.

It will be noted that throughout the appended drawings, like features are identified by like reference numerals.

DETAILED DESCRIPTION OF THE PREFERRED EMBODIMENT

The present invention provides a mixing device for low speed precision mixing of contents of a vessel. For the purposes of the present invention, the term "precision mixing" shall be understood to mean that the contents of a vessel are mixed in a controlled and repeatable manner. The present invention is particularly suited for use in a dissolution measurement apparatus, where repeatable dissolution and mixing are highly important, and especially as a replacement for the paddle type agitator commonly used. Various embodiments of the present invention are described below with reference to FIGS. 2–7.

Figure 1:
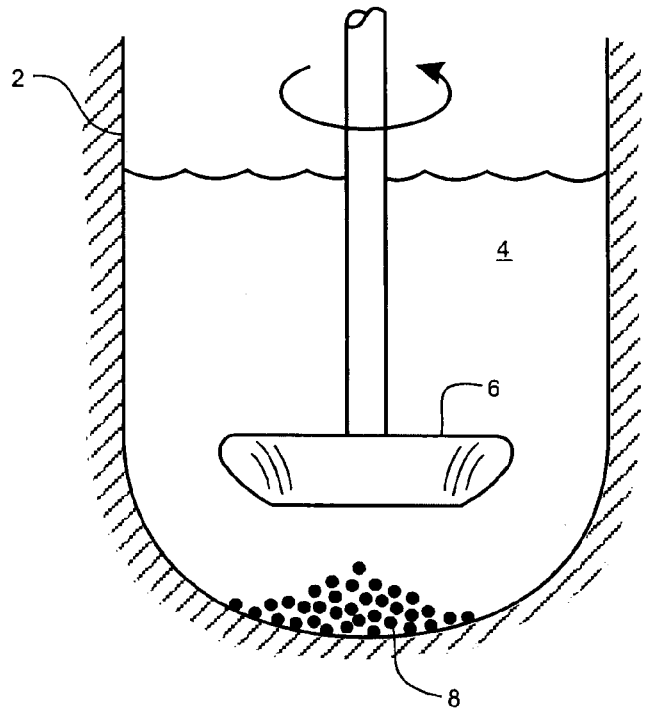
Figure 1 (Prior Art)
FIG. 1 is a sectional view of a prior art paddle mixing apparatus.
Figure 2:
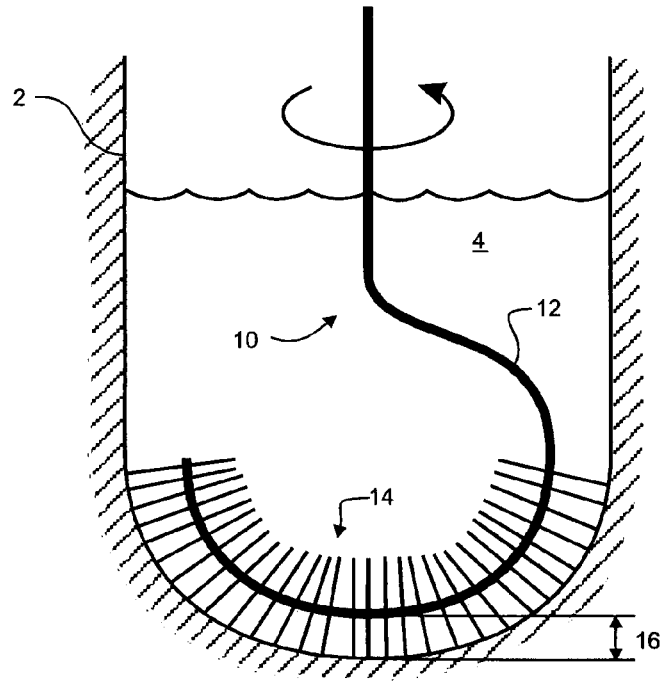
FIG. 2 is a sectional view of a mixing device in accordance with a first embodiment of the present invention.

As shown in FIG. 2, the mixing device 10 generally comprises a support member 12, and a brush assembly 14 mounted on the support member 12. The support member 12 is designed to be rotatably supported in a conventional dissolution vessel 2 containing a dissolution medium 4. The support member 12 at least approximately conforms to the shape of a bottom portion of the dissolution vessel 2 and is separated therefrom by a gap 16. A substantially uniform gap 16 is beneficial, in that it simplifies the design of the brush assembly 14, but it is not necessary. The brush assembly 14 can be mounted on the support member 12 by any suitable means, and fills the gap 16 so as to enter into sliding engagement with the bottom of the vessel 2. In the embodiment of FIG. 2, the brush assembly 14 comprises a plurality of filamentary elements that extend substantially perpendicularly to the support member.

The support member 14 is designed to be coupled to a suitable drive system, such as, for example, a conventional motor-driven spindle (not shown) which imparts a low speed rotation to the support member 12, causing the brush assembly 14 to gently sweep the bottom portion of the dissolution vessel 2. For the purposes of the present invention, the term "low-speed rotation" should be understood to refer to rotation speeds of about 100 rpm or slower, typically in the order of 50 rpm. The resulting low speed sweeping action of the brush assembly 14 minimizes accumulation of disintegrated (i.e., particulate) test product within the vessel 2, and provides substantially continuous low-shear interaction between the dissolution medium 4 and the pharmaceutical product. This action inhibits the formation of vortices within the dissolution medium 4; minimizes the accumulation of disintegrated material at the bottom of the vessel 2; and minimizes shearing, breaking and whipping effects of the mixing device 10 within the vessel 2. All of these factors enhance the precision and repeatability of mixing within the vessel 2.

The support member 12 is preferably comparatively rigid, in order to enable secure coupling to the drive system (not shown) and controlled rotation of the support member 12 and brush assembly 14. For this purpose, the support member 12 may suitably be provided as two or more strands of wire twisted together, or a bar of flat or round material. Preferably, the support member 12 is made of a food grade or other substantially biologically and/or chemically inert material. Similarly, the brush assembly 14 is preferably also made of a food grade (or biologically and/or chemically inert) material such as stainless steel, Teflon™ or nylon.

For the purpose of this invention, the term "inert material" shall be understood to refer to any material that is substantially non-reactive with the vessel or the contents to be mixed, so as to not interfere with the desired chemical or biological process taking place in the vessel. Typical materials usable for the purposes of the present invention include (but are not limited to) stainless steel, polytetrafluoroethylene (PTFE, e.g., Teflon™) stainless steel coated with Teflon™, polyamide polymer (e.g., nylon—trade name) or other food grade plastic.

The vessel 2 shown has a curved, semi-spherical bottom, as in a standard dissolution test apparatus. However, it will be appreciated that the invention is in no way limited to such embodiments. Indeed, the brush assembly can readily be adapted to conform to the bottom of vessels having any desired profile.

Figure 3:
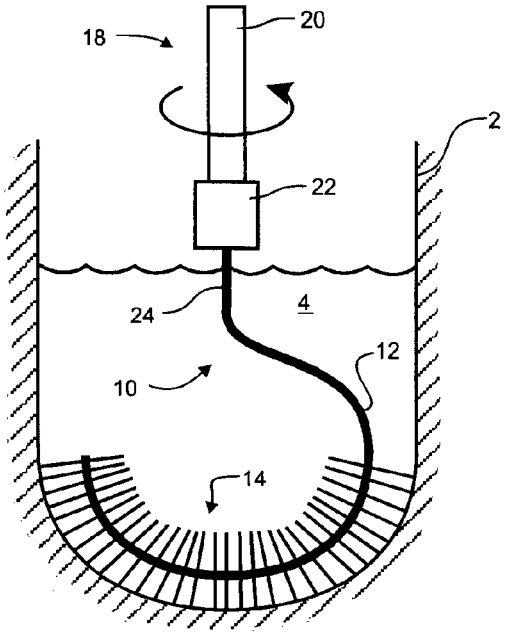
FIG. 3 is a sectional view of the mixing device of FIG. 2, including a coupler and resilient pressure member.

FIG. 3 shows the mixed device 10 of FIG. 2, in which a coupling 18 is used to couple the support member 12 to a drive unit (not shown) such as may be commonly used in a standard dissolution test apparatus. This coupling 18 can be made integral with an upper portion of the support member 12 or may be detachable, as desired. In the embodiment of FIG. 3, the coupling 18 includes a shaft 20 extending from the drive unit, and a resilient pressure member 22. The pressure member 22 is designed to resiliently bias the brush assembly 14 into contact with the bottom portion of the vessel 2. As may be appreciated, the pressure member 22 can be provided as a spring, or any other suitable resilient element, such as, for example, an elastomeric element.

Figure 4:
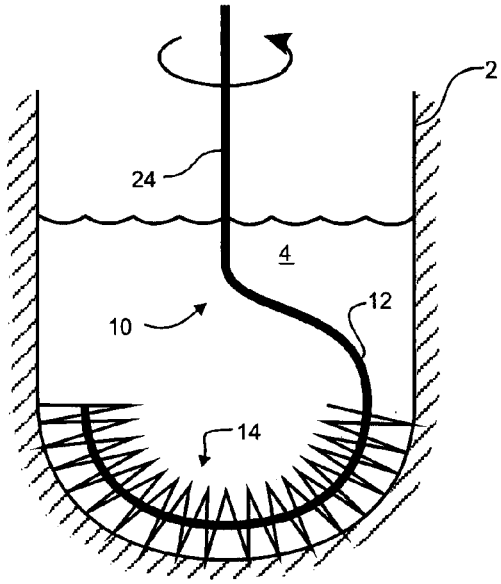
FIG. 4 is a sectional view of a mixing device in accordance with a second embodiment of the invention.
Figure 5:
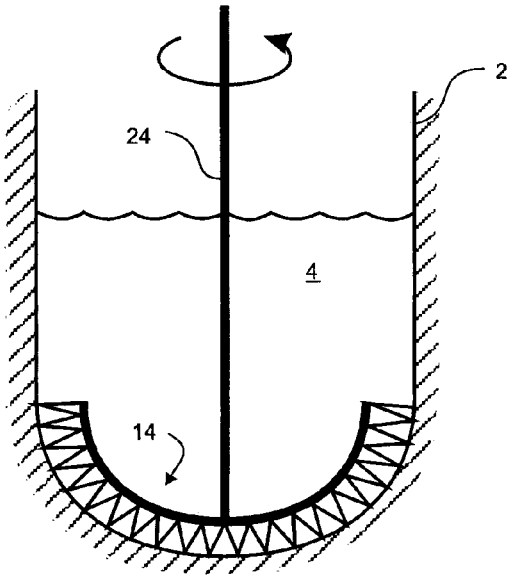
FIG. 5 is a sectional. view of a mixing device in accordance with a third embodiment of the invention.
Figure 6:
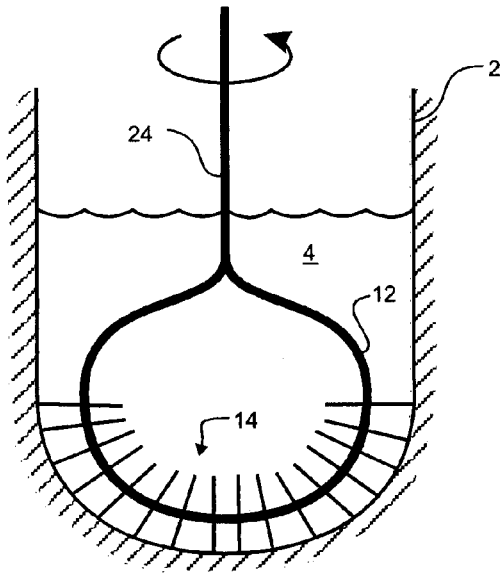
FIG. 6 is a sectional view of a mixing device in accordance with a fourth embodiment of the invention.

FIGS. 4, 5, 6 illustrate principle features of various alternative embodiments of the present invention. In FIG. 4, the brush assembly 14 is provided by a resilient coil affixed to, and surrounding the support member 12. In FIG. 5, the brush assembly 14 is provided by a resilient coil affixed to the support member 12 between the support member 12 and the bottom portion of the vessel 2. This embodiment also includes an alternate design of the support member 12, in which a stem 24 of the mixing device 10 extends from a central portion of the support member 12.

FIG. 6 illustrates an embodiment of the present invention wherein the support member 12 is extended to form a closed loop coupled to the stem 24. FIG. 6 also illustrates an embodiment wherein the brush assembly 14 is provided by a plurality of lamellar elements affixed to the support member 12.

It will be understood that the terms "filamentary elements" and "lamellar elements" are intended to encompass these elements being affixed to the support member 12 at a single point (and having a free end), or at two or more points to thereby form loops.

Figure 7:
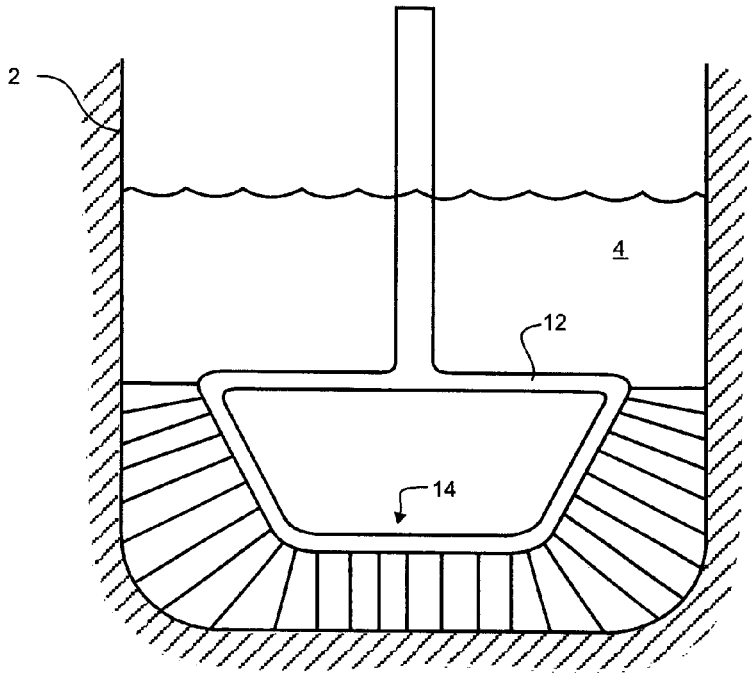
FIG. 7 is a sectional view of a mixing device in accordance with a fifth embodiment of the invention.

FIG. 7 illustrates another embodiment of the present invention wherein the support member 12 does not conform to the contour of the bottom portion of the (now flat-bottomed) vessel 2. In this case, the brush assembly 14 is mounted on the support member 12, and is extended to bridge the unequal gap between the support member 12 and the bottom portion of the vessel 2. Thus the brush assembly 12 enters into sliding engagement with the bottom portion of the vessel 2, in spite of the unequal gap.

As will be appreciated from the forgoing, the various support members 12 and brush assemblies 14 illustrated in FIGS. 2–7 may be combined as desired, without departing from the scope of the invention. Thus it will be understood that the present invention is in no way restricted to the specific combinations illustrated in FIGS. 3–7.

Figure 8:
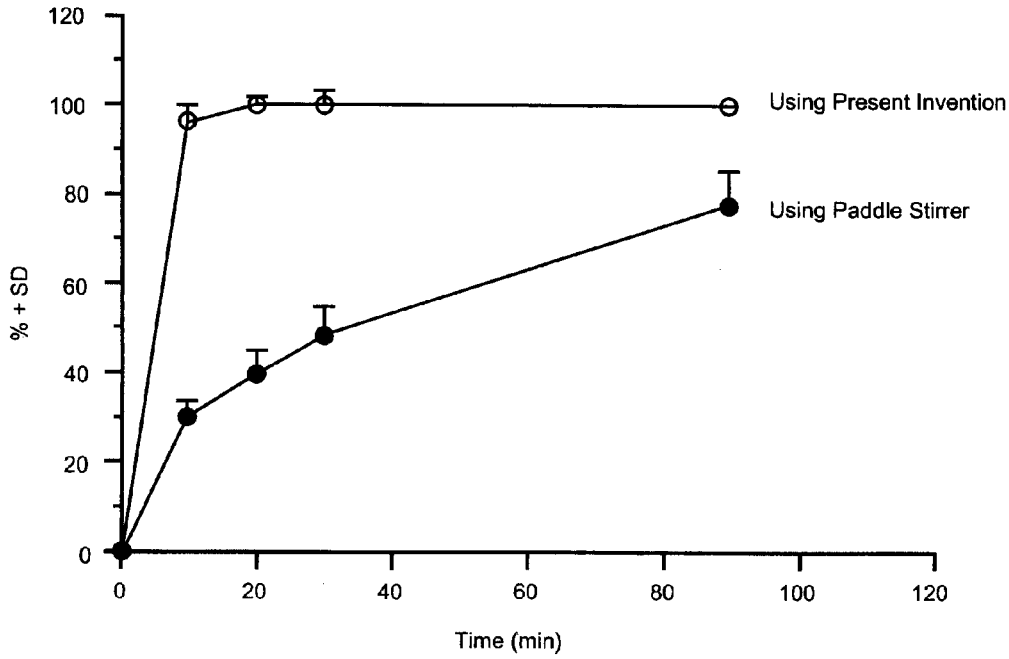
FIG. 8 is a graph showing exemplary comparative dissolution profiles obtained using the prior art paddle mixer and the mixing device of FIGS. 2 and 3.

FIG. 8 is a graph illustrating exemplary comparative dissolution profiles of the prior art paddle mixer and a mixing device 10 in accordance with the present invention. In this example, drug release profiles of a commercially available 250 mg amoxicillin capsule product are described. The test product is a conventional release product i.e., fast-release drug product. Two sets of experiments were conducted using a 6-spindle dissolution apparatus with six identical dissolution vessels, each having 900 ml of dissolution medium. In one experiment, each spindle drove a prior art paddle mixer. In the other experiment, each spindle drove a mixing device 10 in accordance with the present invention. In both experiments, the spindles were rotated at 50 rpm.

The bottom curve represents the percentage dissolution versus time for the prior art paddle stirrer. Although the product is a fast-release product by rapidly releasing the content of capsule shell, in this case the drug's appearance in solution is delayed due to poor interaction of the dissolution medium (liquid) with the drug product using the paddle stirrer. The dissolution curve seems to imply that the test product is a slower release product than it actually is.

The top curve represents the percentage dissolution versus time achieved using the present invention. In this case, the interaction of the dissolution medium with the product is enhanced using the present invention and the dissolution curve more accurately reflects dissolution characteristics of the fast drug release product.

The embodiment(s) of the invention described above is (are) intended to be exemplary only. The scope of the invention is therefore intended to be limited solely by the scope of the appended claims.

I claim:

1. A mixing device for low speed precision mixing and dissolution of a solid pharmaceutical product into a dissolution medium contained within a vessel, the mixing device comprising:

a support member including a coupler for releasably affixing the mixing device to a drive system for rotation of the mixing device within the vessel;

a brush assembly depending from the support member and adapted for sliding engagement with a bottom portion of the vessel;

a resilient pressure member for biasing the brush assembly into contact with the bottom portion of the vessel;

wherein the brush assembly comprises a plurality of lamellar elements affixed to the support member wherein low speed rotation of the mixing device causes the brush assembly to sweep substantially the entire bottom portion of the vessel during each rotation of the mixing device, and induces a substantially continuous low-shear interaction between the pharmaceutical product and the dissolution medium.

* * * * *